United States Patent [19]

Lauckhardt et al.

[11] Patent Number: 4,811,177

[45] Date of Patent: Mar. 7, 1989

[54] LONG FIELD LAMP

[75] Inventors: Gerhard Lauckhardt, St. Georgen; Hadmar Kurzmann, Stein an der Traun, both of Fed. Rep. of Germany

[73] Assignee: Siemens Aktiengesellschaft, Berlin and Munich, Fed. Rep. of Germany

[21] Appl. No.: 202,306

[22] Filed: Jun. 6, 1988

[30] Foreign Application Priority Data

Aug. 13, 1987 [DE] Fed. Rep. of Germany ... 8711056[U]

[51] Int. Cl.[4] ..... F21V 19/02

[52] U.S. Cl. ..... 362/220; 362/285

[58] Field of Search ..... 362/217, 220, 223, 225, 362/260, 285

[56] References Cited

U.S. PATENT DOCUMENTS

| | | | |
|---|---|---|---|
| 2,399,531 | 4/1946 | Young . | |
| 3,252,125 | 5/1966 | Moss | 362/220 X |
| 3,742,203 | 6/1973 | Noe | 362/220 X |
| 4,161,019 | 7/1979 | Mulvey | 362/220 X |
| 4,238,815 | 12/1980 | Price | 362/218 |

FOREIGN PATENT DOCUMENTS

| | | |
|---|---|---|
| 160186 | 9/1986 | Austria . |
| 1641917 | 7/1952 | Fed. Rep. of Germany . |
| 2252991 | 5/1974 | Fed. Rep. of Germany . |
| 1534064 | 7/1968 | France . |

*Primary Examiner*—Stephen F. Husar

[57] ABSTRACT

A long field lamp whose housing is provided for the optional insertion of different mirror arrangements in order to realize different radiation characteristics in accordance with desired demands. The long field lamp has different positions of the fluorescent tube dependent upon the mirror arrangement used. These different positions can be realized with mounts adjustable in vertical and horizontal directions. An adjustable mount has a holder composed of a frame for accepting the mount and has a foot plate attached and aligned perpendicularly thereto. For horizontal displacement, the foot plate is held in the region of an end wall of a lamp housing with clamp feet in displacement slots in a housing floor of the lamp housing. The vertical displacement of the mount is provided in that the mount is introduceable into the frame at differing distances from the foot plate.

8 Claims, 2 Drawing Sheets

LONG FIELD LAMP

BACKGROUND OF THE INVENTION

The present invention is directed to a long field lamp composed of a lamp housing, a mirror arrangement insertable into a light exit opening of the lamp housing and mounts for holding and contacting at least one fluorescent tube. These mounts are horizontally as well as vertically adjustably arranged in the region of the end walls of the lamp housing.

In the prior art as disclosed, for example, by the German reference No. DE-GM1 641 917, fluorescent tubes are secured in their mounts in the lamp housing such that their position relative to the mirror arrangement can be varied as desired within prescribed limits. A radiation characteristic of the lamp can be better adapted to different demands in this manner. An analogous case applies when different mirror arrangements are optionally insertable into a lamp housing which has nonvariable dimensions. Every mirror arrangement thereby has a set position relative to the fluorescent tube whereby this position is a respectively different position dependent on the mirror arrangement used.

An adjustable arrangement of the mounts in such fashion that they are secured to an adjustable or pivotable lever in the region of the end wall of the housing results in a rather complex structure. As the reference of German published application 22 52 991 discloses the mount may be secured to different locations on the end wall of the lamp housing as desired by partially cutout sheet metal tabs which are provided in the end wall at specified locations. As needed, these sheet metal tabs can be bent up into a predetermined position for holding a mount and the mounts can be anchored therein. Such a fastening of the mounts greatly complicates making subsequent desired changes in position and also requires special tools for making the change.

SUMMARY OF THE INVENTION

An object of the present invention is to provide an improved mount adjustment for a long field lamp of the type initially described and which is structurally simple so that a rapid adjustment can be executed without the use of a tool.

The present invention has a mount to be secured in a lamp housing having a holder. A suitable design of the holder thus makes it possible to simply realize the desired adjustment in a horizontal and in a vertical direction in a repeatable fashion and without the use of special tools. The present invention is based on, first, a displaceable fastening of the holder to the floor of the housing of the lamp housing and, second, on an adjustable arrangement of the mount and the holder.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
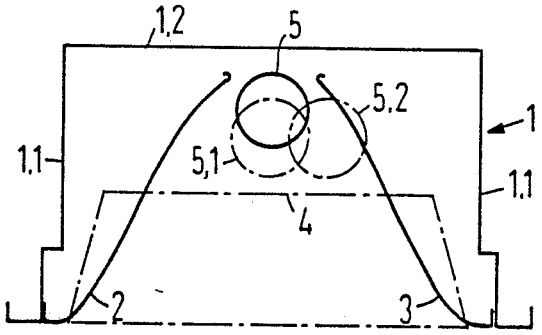
FIG. 1 is a cross-sectional schematic illustration of a long field lamp having an integrated mirror arrangement.

The schematic illustration of FIG. 1 shows a cross-section through a box-shaped lamp housing 1 having longitudinal side walls 1.1 and a housing floor 1.2 as is usually provided for a long field lamp for incorporation into an intermediate ceiling. Dependent on the desired radiation characteristic of such a long field lamp, different mirror arrangements can be inserted into the lamp housing 1 from the side of the light exit opening. The mirror arrangement indicated in FIG. 1 is composed of two parabolically curved side mirrors 2 and 3 as well as of mirror grid lamellae 4 arranged transversely relative thereto. The mirror grid lamellae are indicated with a broken line in FIG. 1. For varying the radiation characteristic, the fluorescent tube 5 can be adjusted in a vertically downward direction in its mount into the circle 5.1 illustrated by a broken line. Further, the broken-line 5.2 indicates a possible horizontal adjustment of the fluorescent tube 5 that, however, does not come into consideratin for the mirror arrangement shown in FIG. 1.

Figure 2:
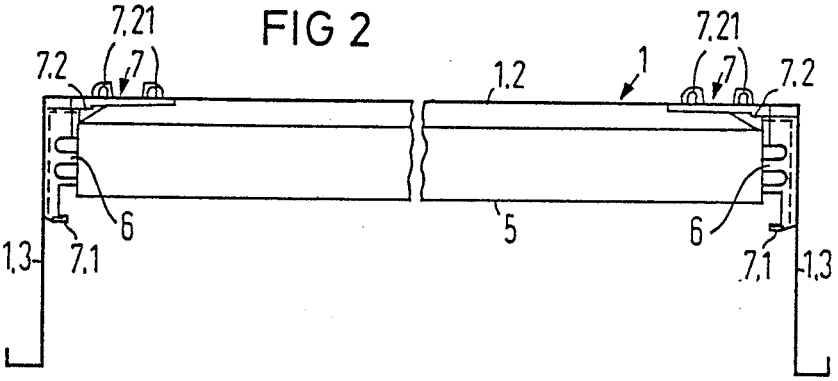
FIG. 2 is a schematic illustration of a long field lamp having adjustable mounts shown in a longitudinal section.

A long field lamp equipped with such a mount adjustment is shown in longitudinal section in FIG. 2. Each of the mounts 6 into which the fluorescent tube 5 is inserted has a holder 7 allocated to it that is composed of a vertical frame 7.1 for accepting the mount 6 parallel to the end wall 1.2 and of a horizontally directed foot plate 7.2 parallel to the housing floor 1.2. In the immediate proximity of the end wall 1.3 of the lamp housing 1, the holder 7 has the frame 7.1 secured to the housing floor 1.2 by its foot plate 7.2. To this end, the foot plate 7.2 has two clamp feet 7.21 at its underside following one another in a longitudinal direction with which they engage in nonpositive fashion two displacement slots 1.21 proceeding parallel to the end walls 1.3 (also see FIG. 7).

Figure 3:
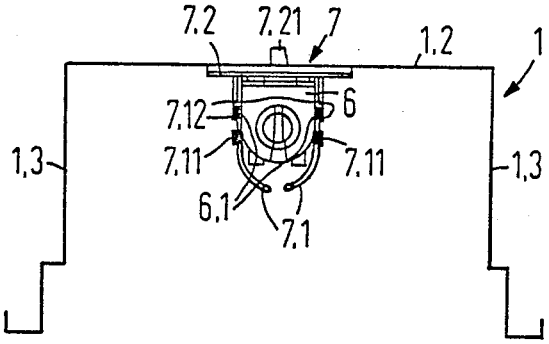
FIGS. 3–5 are cross-sectional views of the long field lamp of FIG. 2 for different attitudinal position of the mounts.

In the first cross-sectional view of the long field lamp according to FIG. 3, the mount 6 in the lamp housing 1 is in the position indicated by the fluorescent tube 5 of FIG. 1. At its outside, the mount that is adjustably insertable in a vertical direction in the frame 7.1 of the holder 7 has two retaining webs 6.1 lying opposite one another with which it engages into one of the pairs of guide channels 7.11 and 7.12 of the frame 7.1 for a desired vertical position. In FIG. 3, the mount 6 has its smallest spacing from the footplate 7.2 at the housing floor 1.2 of the lamp housing 1 and has its retaining webs 6.1 engaging into the pair of guide channels 7.12 of the frame 7.1.

Figure 4:
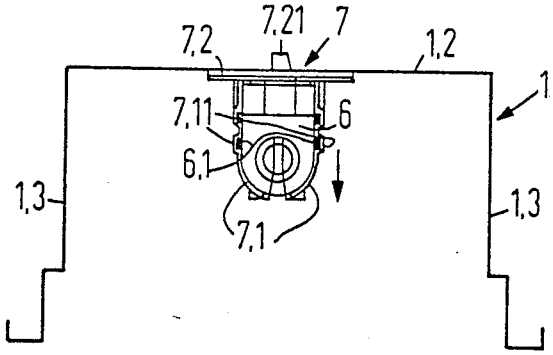

The illustration of the long field lamp of FIG. 4 corresponds to that of FIG. 3 with the difference being that the mount 6 has its retaining webs 6.1 engaging the pair of guide channels 7.11. It has now been shifted in the direction of the light exit opening of the lamp housing 1 in accordance with the indicated arrow direction and into a position that corresponds to the position of the circle 5.1 of FIG. 1.

Figure 5:
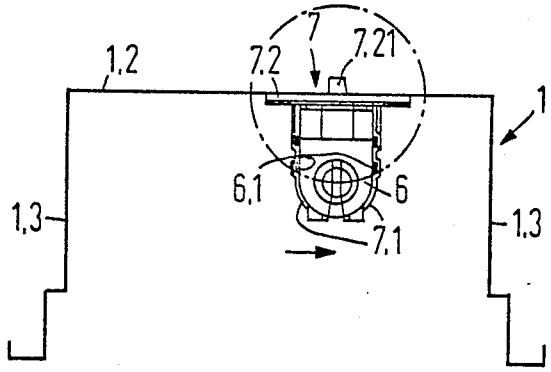

The illustration of the long field lamp of FIG. 5 corresponds to that of FIG. 4 with the difference being that the mount 6 has now been displaced in its holder 7 parallel to the end walls 1.3 in the arrow direction toward the right in the displacement slots 1.21 in the housing floor 1.2. It is displaced into the position that is indicated in FIG. 1 by the circle 5.2.

Figure 6:
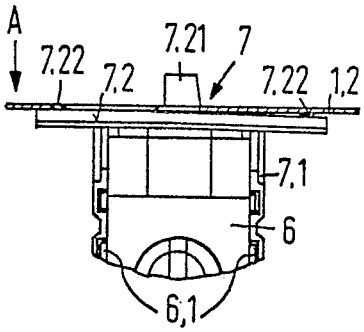
FIG. 6 is a view of a portion of the long field lamp of FIG. 5 in the region of the adjustable mount.
Figure 7:
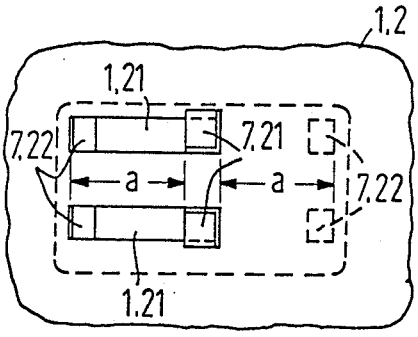
FIG. 7 is a plan view of the portion of FIG. 6.

Referring now to the circle shown in FIG. 5 and referring to FIG. 6 and a plan view of the FIG. 6 portion shown in FIG. 7, the underside of the foot plate 7.2 additionally has a catch cam 7.22 on both sides at the level of one of the clamp feet 7.21. The distance of this catch cam 7.22 from the appertaining clamp foot 7.21 indicated in FIG. 7 is selected to be equal to the maximum displacement of the holder 7 in the displacement slots 2.21 to the detent of the clamp feet 7.21 at one of the two ends of the displacement slots, the catch cams belonging to the clamp feet 7.21 engage the displacement slots 1.21 at the other of the two ends. In the illustration of FIGS. 6 and 7, these are the two left-hand catch cams 7.22 that additionally engage into the displacement slots 1.21 for the indicated shifted position of the holder 7.

The long field lamp that has been set forth can be used in various equipped modifications both as a suspended lamp as well as a ceiling-recessed lamp in interior areas.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A long field lamp composed of a lamp housing, of a mirror arrangement introduceable into a light exit opening in the lamp housing and of mounts for holding and contacting at least one fluorescent tube, the mounts being arranged both horizontally as well as vertically adjustable in the region of end walls of the lamp housing, comprising each mount having a holder composed of a frame for accepting the mount and having a foot plate attached and aligned perpendicularly thereto at a lower end thereof; the frame having means for inserting the mount in at least two different distances over the foot plate; and an underside of the foot plate having at least two resilient clamp feet arranged following one another at a predetermined distance in a longitudinal direction with which the holder engages in nonpositive fashion displacement slots that are provided in the region of housing end faces and, parallel thereto, in a housing floor of the lamp housing.

2. The long field lamp according to claim 1, wherein the length of the displacement slots with their two ends each having a detent for engaging the clamp feet of the holder define the two displacement positions of the mount in a horizontal direction.

3. The long field lamp according to claim 1, wherein the width of the foot plate is approximately twice the length (a) of the holder between its two displacement positions in a horizontal direction and has a catch cam at both sides of the clamp foot in this length (a), said catch cam being located at the underside of the foot plate; and dependent on one of the selected displacement positions of the holder in the horizontal direction, the one or the other of the two catch cams allocated to a clamp foot engages the appertaining displacement slot by locking into this selected displacement position.

4. The long field lamp according to claim 1, wherein the frame of the holder accepting the mount has pairs of guide channels over its length that proceed perpendicularly relative to its length, said pairs of guide channels arranged above one another at sides lying opposite one another; and wherein the mount has two retaining webs lying opposite one another at its outside, said retaining webs engaging one of the pairs of guide channels when inserted into the frame, engaging thereinto in a vertical direction in accordance with a desired displacement position.

5. A long field lamp composed of a lamp housing, of a mirror arrangement introduceable into a light exit opening in the lamp housing and of mounts for holding and contacting at least one fluorescent tube, the mounts being arranged both horizontally as well as vertically adjustable in the region of end walls of the lamp housing, comprising each mount having a holder composed of:

a frame for accepting the mount, the frame having pairs of guide channels over its length that proceed perpendicularly relative to its length, said pairs of guide channels arranged above one another at sides lying opposite one another, the mount having two retaining webs lying opposite one another at its outside, said retaining webs engaging one of the pairs of guide channels when inserted into the frame, engaging thereinto in a vertical direction in accordance with a desired displacement position;

a foot plate attached and aligned perpendicularly to the frame at a lower end thereof, an underside of the foot plate having at least two resilient clamp feet arranged following one another at a predetermined distance in a longitudinal direction with which the holder engages in nonpositive fashion displacement slots that are provided in the region of housing end faces and, parallel thereto, in a housing floor of the lamp housing.

6. The long field lamp according to claim 5, wherein the length of the displacement slots with their two ends each having a detent for engaging the clamp feet of the holder define the two displacement positions of the mount in a horizontal direction.

7. The long field lamp according to claim 5, wherein the width of the foot plate is approximately twice the length (a) of the holder between its two displacement positions in a horizontal direction and has a catch cam at both sides of the clamp foot in this length (a), said catch cam being located at the underside of the foot plate; and dependent on one of the selected displacement positions of the holder in the horizontal direction, the one or the other of the two catch cams allocated to a clamp foot engages the appertaining displacement slot by locking into this selected displacement position.

8. A long field lamp composed of a lamp housing, of a mirror arrangement introduceable into a light exit opening in the lamp housing and of mounts for holding and contacting at least one fluorescent tube, the mounts being arranged both horizontally as well as vertically adjustable in the region of end walls of the lamp housing, comprising each mount having a holder composed of:

a frame for accepting the mount, the frame having pairs of guide channels over its length that proceeds perpendicularly relative to its length, said pairs of guide channels arranged above one another at sides lying opposite one another, the mount having two retaining webs lying opposite one another at its outside, said retaining webs engaging one of the pairs of guide channels when inserted into the frame, engaging thereinto in a vertical direction in accordance with a desired displacement position;

a foot plate attached and aligned perpendicularly to the frame at a lower end thereof, an underside of the foot plate having at least two resilient clamp feet arranged following one another at a predetermined distance in a longitudinal direction with which the holder engages in nonpositive fashion displacement slots that are provided in the region of housing end faces and, parallel thereto, in a housing floor of the lamp housing, the length of the displacement slots with their two ends each having a detent for engaging the clamp feet of the foot plate defining the two displacement positions of the mount in a horizontal direction, the width of the foot plate being approximately twice the length (a) of the holder between its two displacement positions in a horizontal direction and having a catch cam at both sides of the clamp foot in this length (a), said catch cam being located at the underside of the foot plate, and dependent on one of the selected displacement positions of the holder in the horizontal direction, one or the other of the two catch cams allocated to a clamp foot engaging the appertaining displacement slot by locking into this selected displacement position.

* * * * *